US006945914B1

(12) United States Patent
Cheng

(10) Patent No.: US 6,945,914 B1
(45) Date of Patent: Sep. 20, 2005

(54) CLIMBING TRAINING MACHINE

(75) Inventor: Chia-Hsiang Cheng, Taichung (TW)

(73) Assignee: Sportek Industrial Co., Ltd., Taichung (TW)

( * ) Notice: Subject to any disclaimer, the term of this patent is extended or adjusted under 35 U.S.C. 154(b) by 0 days.

(21) Appl. No.: 10/878,378

(22) Filed: Jun. 29, 2004

(51) Int. Cl.[7] ..... A63B 22/02
(52) U.S. Cl. ..... 482/54; 482/51
(58) Field of Search ..... 482/51, 54, 148

(56) References Cited

U.S. PATENT DOCUMENTS

2002/0094916 A1 * 7/2002 Wang et al. ..... 482/54
2003/0224908 A1 * 12/2003 Lin ..... 482/54
2004/0058785 A1 * 3/2004 Wu ..... 482/54
2004/0192513 A1 * 9/2004 Chang ..... 482/54

* cited by examiner

*Primary Examiner*—Gregory L. Huson
*Assistant Examiner*—Tam Nguyen
(74) *Attorney, Agent, or Firm*—Rosenberg, Klein & Lee

(57) ABSTRACT

A climbing training machine has a fixed frame, a movable frame fitted to the fixed frame, a telescopic screw bar connected to the fixed frame and the movable frame, an elevating frame pivoted on the movable frame at a side distal to the fixed frame, a supporting frame having opposite ends pivoted on a middle section of the elevating frame and the fixed frame and a running belt mounted on the elevating frame for rotation. The elevating frame can adjust its slope for the user to walk or run on the belt in various difficult levels.

4 Claims, 5 Drawing Sheets

CLIMBING TRAINING MACHINE

BACKGROUND OF THE INVENTION

1. Field of the Invention

The present invention relates generally to a training machine, and more particularly to a climbing training machine, which is capable to reduce its size and can sustain more loading.

2. Description of the Related Art

FIG. 4 and FIG. 5 show a conventional climbing training machine, which has a base 81 on which two handles 81 and a panel 82 are mounted. The base 81 is further provided with a movable frame 84 and a belt 85 mounted around the movable frame 84. A motor (not shown) is mounted to drive the belt 85. Two electric screw devices 9 are mounted at between of the movable frame 84 and the base 81 respectively. The electric screw devices (incline motors) 9 have opposite ends connected to opposite sides of the movable frame 84 and the base 81 respectively to elevate the movable frame 84. As a result, the movable frame 84 is adjustable of its slope to train user.

The electric screw devices 9 are to support the movable frame 84. While a user walk or run on the belt 85, the weight of the user and the impact when training might make the electric screw assemblies 9 deformed. And while the electric screw devices 9 are deformed, it will affect the movement of the movable frame 84. If the deformation is serious, the electric screw devices 9 might not works anymore.

The base 81 of the conventional climbing training machine is a fixed member that can not be folded, so that the conventional climbing training machine is inconvenient for storage and transport.

The conventional climbing training machine needs two sets of the electric screw devices 9 to adjust the slope of the movable frame 84 and that increase the cost of manufacture.

SUMMARY OF THE INVENTION

The primary objective of the present invention is to provide a climbing training machine, which provides a fixed frame, a movable frame fitted to the fixed frame and a telescopic screw bar connected to the fixed frame and the movable frame. The movable frame is pivoted with an elevating frame at a side distal to the fixed frame. A supporting frame is pivoted both on a middle section of the elevating frame and the fixed frame. The telescopic screw bar can adjust its length to move the movable frame for changing the slope of the elevating frame. While the movable frame is moved inwards, the total size thereof is reduced.

The second objective of the present invention is to provide a climbing training machine, which only one of the telescopic screw bar is connected to the fixed frame and the movable frame to adjust the slope of the elevating frame. That reduces the cost of manufacture.

According to the objectives of the present invention, a climbing training machine comprises a fixed frame, a movable frame fitted to the fixed frame, a telescopic screw bar connected to the fixed frame and the movable frame, an elevating frame pivoted on the movable frame at a side distal to the fixed frame, a supporting frame having opposite ends pivoted on a middle section of the elevating frame and the fixed frame and a running belt mounted on the elevating frame for rotation. The telescopic screw bar can adjust its length to move the movable frame relatively to the fixed frame and to change a slope of the elevating frame.

DETAILED DESCRIPTION OF THE INVENTION

Figure 1:
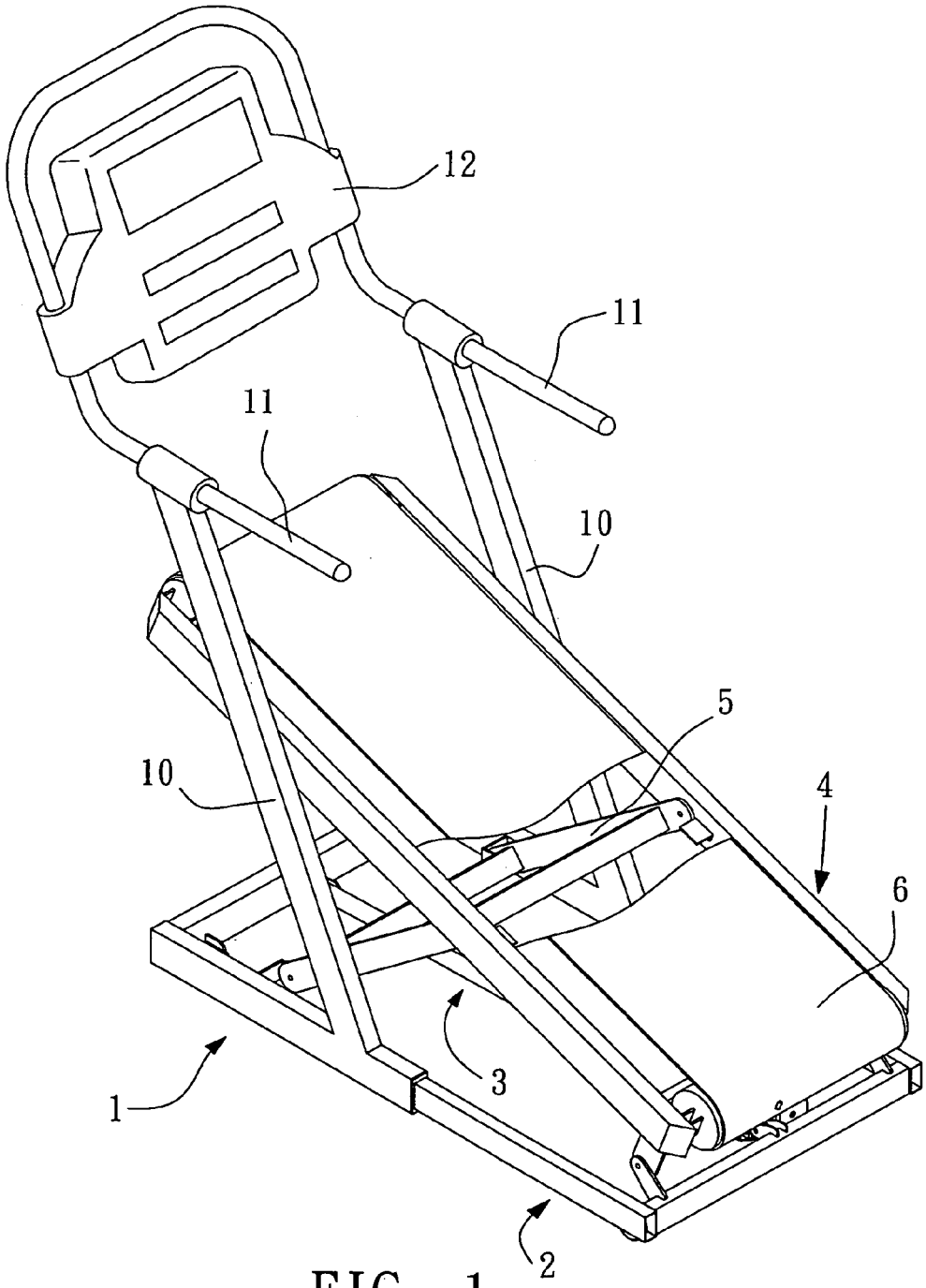
FIG. 1 is a perspective view of a preferred embodiment of the present invention.
Figure 2:
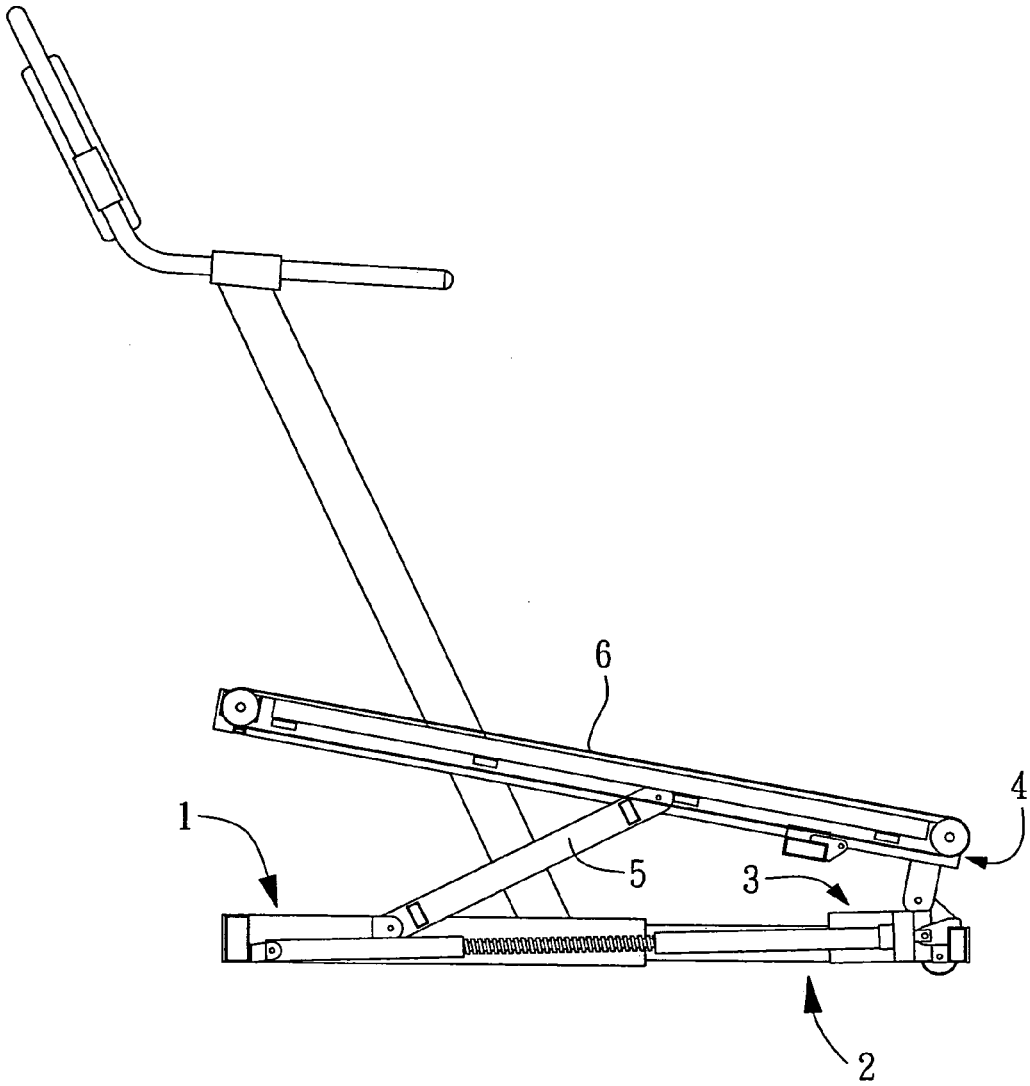
FIG. 2 is a lateral view of the preferred embodiment of the present invention in combination.
Figure 3:
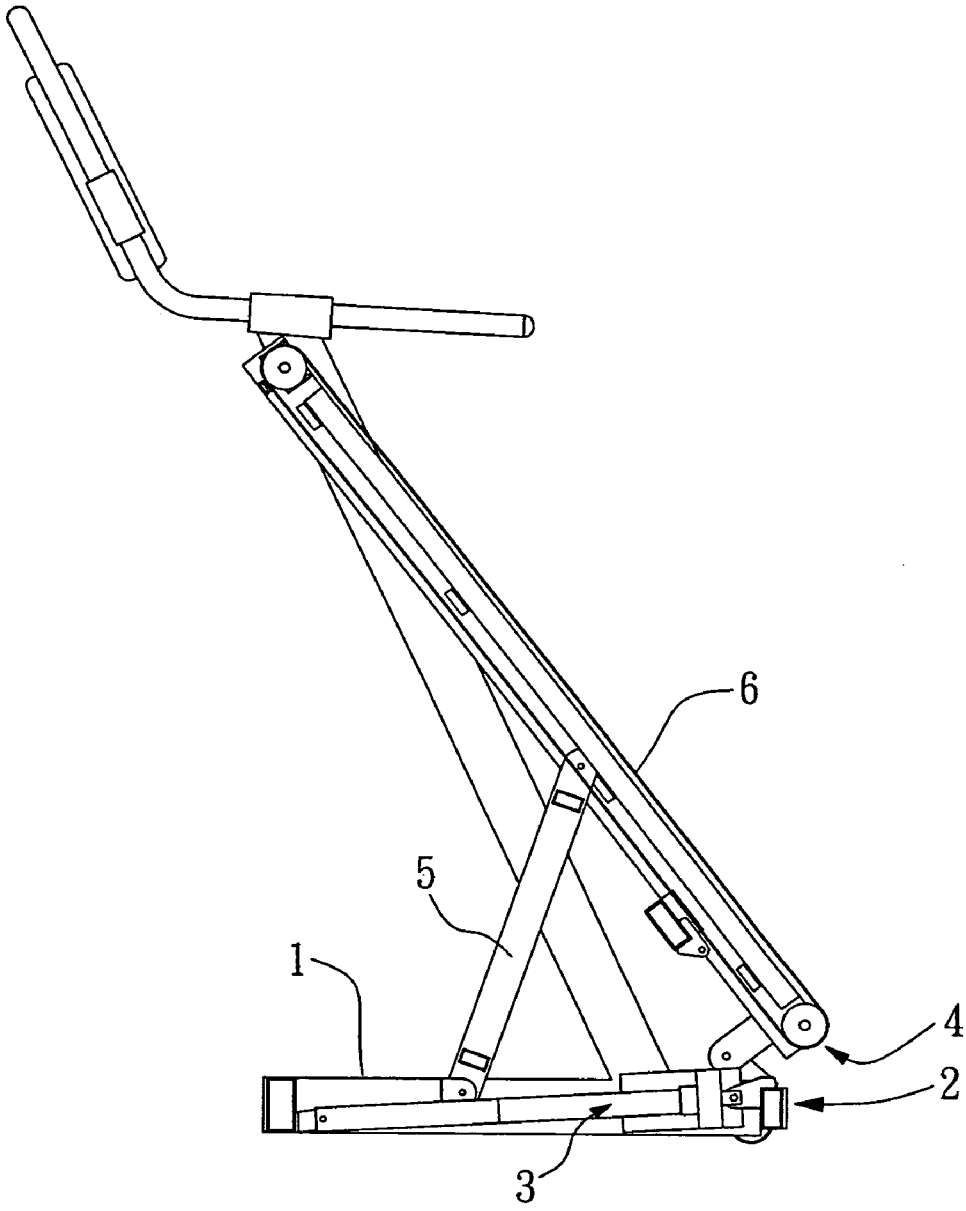
FIG. 3 is a perspective view of the collapsed condition of the preferred embodiment of the present invention.
Figure 4:
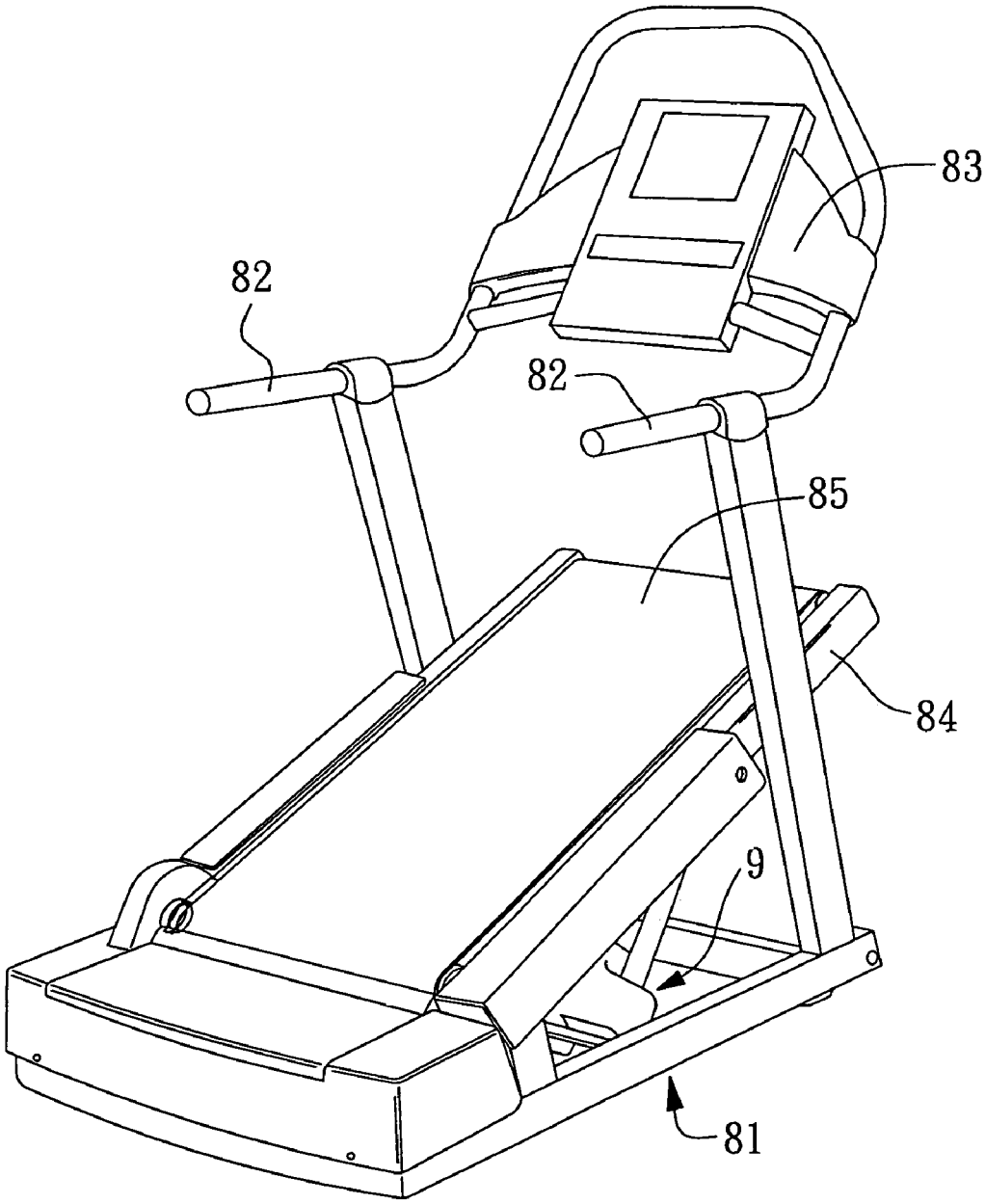
FIG. 4 PRIOR ART
FIG. 4 is a perspective view of the conventional climbing training machine.
Figure 5:
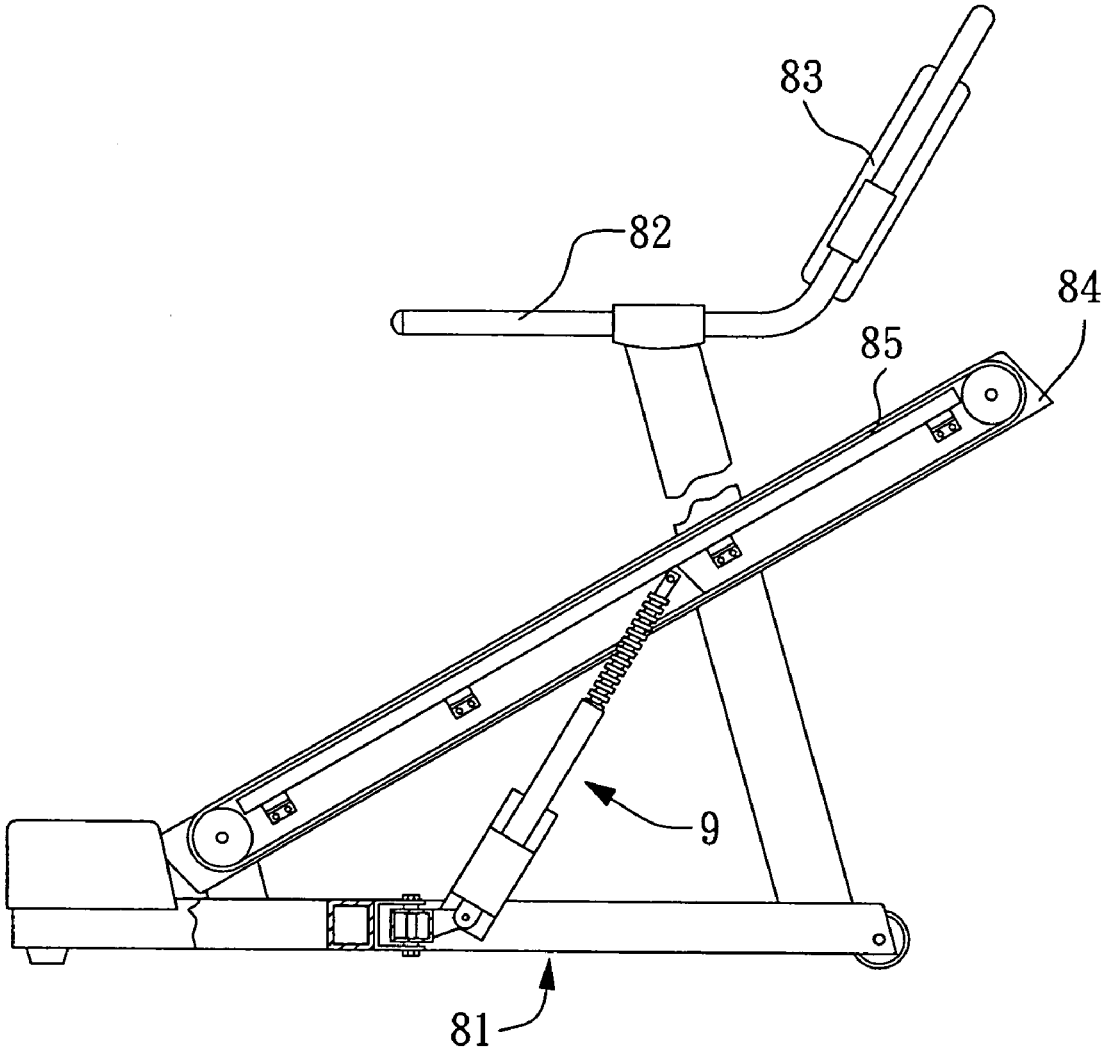
FIG. 5 PRIOR ART
FIG. 5 is a lateral view of the conventional climbing training machine.

As shown in FIGS. from FIG. 1 to FIG. 3, a climbing training machine comprises a fixed frame 1, two console mast 10 mounted at two sides of the fixed frame 1 respectively and two handles 11 and a panel console 12 mounted on the upright frames 12.

The fixed frame 1 is provided with a movable frame 2 and a telescopic screw bar 3 connected to the fixed frame 1 and the movable frame 2. In the present invention, the telescopic screw bar 3 is an electric actuator. An elevating frame 4 is pivoted on the movable frame 2 at a side distal to the fixed frame 1. A supporting frame 5 is pivoted on a middle section of the elevating frame 4. The supporting frame 5 has two bars with opposite ends pivoted on the fixed frame 1 and the elevating frame 4 respectively and two cross bars with ends fastened to the bars respectively. The telescopic screw bar 3 can adjust its length to move the movable frame 2 relative to the fixed frame 1. As a result, the elevating frame 4 is moved therewith to change its slope. The elevating frame 4 is provided with an electric belt 6 for user to walk or run on it.

While using, the telescopic screw bar 3 is adjusted for its length to change the slope of the elevating frame 4 via the movable frame 2, as shown in FIG. 2. The user can walk or run on the belt to train his/her physical capacity.

The supporting frame 5 is the one to support the belt rather than the telescopic screw bar 3, so that the telescopic screw bar 3 has less chance to be damaged. The four bars of the supporting frame 5 provide a well strength to withstand the loading, so that the climbing training machine have a greater strength to sustain the weight of the user and the impact when the user walks or runs on it.

While storing the climbing training machine of the present invention, the movable frame 2 is moved toward the fixed frame 1 and, therefore, the elevating frame 2 is turned to have a greater slope, as shown in FIG. 3, so that the size of the machine is reduce for convenience of storage and transport.

There is only one of the telescope screw bar in the climbing training machine of the present invention to adjust the slope of the elevating frame 4. The climbing training machine of the present invention provides fewer components than the conventional climbing training machine, which means the present invention has less cost of manufacture.

What claimed is:

1. A climbing training machine, comprising a fixed frame, a movable frame displaceably fitted to the fixed frame, a telescopic screw bar connected to the fixed frame and the movable frame, an elevating frame pivoted on the movable frame at an end distal to the fixed frame, a supporting frame having opposite ends pivoted on an intermediate portion of the elevating frame and an intermediate portion the fixed frame and a running belt mounted on the elevating frame for rotation, wherein the telescopic screw bar can adjust its length to longitudinally displace the movable frame relative to the fixed frame to change the elevating frame's slope.

2. The climbing training machine as defined in claim 1, wherein the fixed frame has two console masts respectively at opposite sides thereof, two handles mounted on the console masts respectively and a panel mounted on the handles.

3. The climbing training machine as defined in claim 1, wherein the telescopic screw bar is an electric actuator.

4. The climbing training machine as defined in claim 1, wherein the supporting frame has two bars with opposite ends pivoted on the elevating frame and the fixed frame respectively and two transverse bars connected to the bars respectively to support the elevating frame.

* * * * *